United States Patent [19]

Murphree

[11] Patent Number: 4,643,624

[45] Date of Patent: Feb. 17, 1987

[54] GUIDE MEANS FOR STABILIZING PIPE STRINGS

[76] Inventor: Pat D. Murphree, Rte. 1, Box 120-A, Midland, Tex. 79701

[21] Appl. No.: 743,565

[22] Filed: Jun. 11, 1985

[51] Int. Cl.[4] ..... E21B 19/14

[52] U.S. Cl. ..... 414/22; 24/299; 175/85

[58] Field of Search ..... 414/22, 745; 175/85; 166/77.5, 85; 248/228, 231.6; 24/299

[56] References Cited

U.S. PATENT DOCUMENTS

| | | | |
|---|---|---|---|
| 2,206,185 | 7/1940 | Graham et al. | 414/22 X |
| 2,692,059 | 10/1954 | Bolling, Jr. | 414/22 |
| 2,828,024 | 3/1958 | True | 414/22 |
| 2,926,891 | 3/1960 | Holt | 414/22 |
| 3,533,516 | 10/1970 | Guier | 414/22 |
| 4,111,388 | 9/1978 | Presley | 248/49 |
| 4,172,684 | 10/1979 | Jenkins | 414/22 |
| 4,274,777 | 6/1981 | Scaggs | 414/22 |
| 4,343,093 | 8/1982 | Eadens | 24/299 X |
| 4,432,691 | 2/1984 | Sterner | 414/735 |
| 4,440,536 | 4/1984 | Scaggs | 414/22 |
| 4,472,099 | 9/1984 | Hahn | 414/401 |

FOREIGN PATENT DOCUMENTS

| | | | |
|---|---|---|---|
| 107772 | 11/1924 | Switzerland | 24/299 |

*Primary Examiner*—Leslie J. Paperner

*Attorney, Agent, or Firm*—Marcus L. Bates

[57] ABSTRACT

A guide means is removably affixed to the derrick of a workover rig or the like for capturing and stabilizing a medial part of a pipe section as a pipe string is being made up and run into a wellbore. The guide apparatus is pivotally mounted to the derrick so that it can be extended into operative relationship respective to the pipe section, and is retracted clear of the string by remote control. The apparatus includes a yoke which is pivoted from a substantially vertical into a substantially horizontal position. The yoke is adjusted so that the apex thereof coincides with the central axis of the pipe, and as the yoke is moved from the retracted to the operation position, the pipe section is forced to move into the yoke apex, thereby properly aligning the pipe section with the pipe string and with the borehole. Adjustment means enables precise orientation of the yoke respective to the axial centerline of the pipe string.

9 Claims, 7 Drawing Figures

FIG. 1
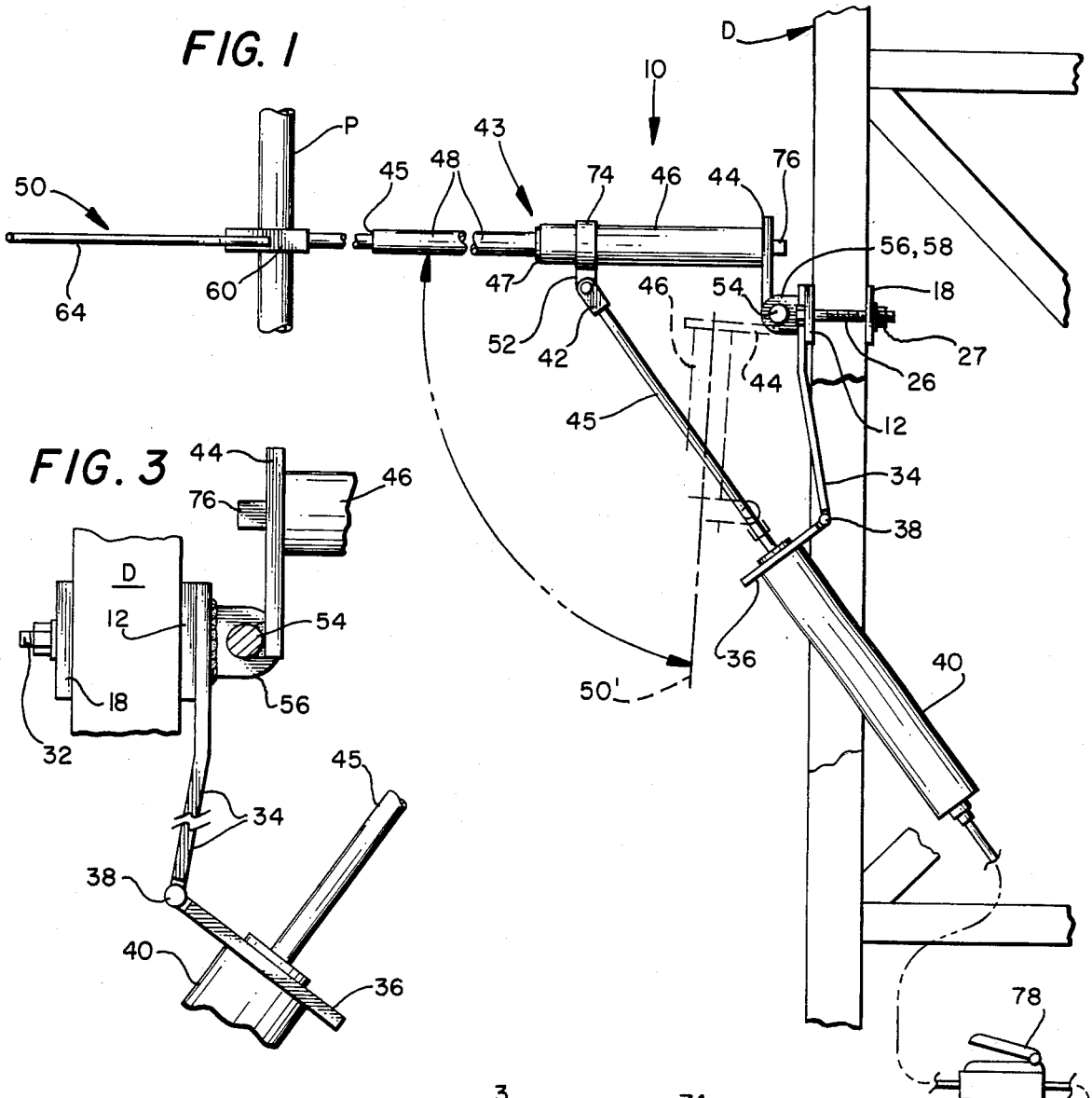
FIG. 3
FIG. 2
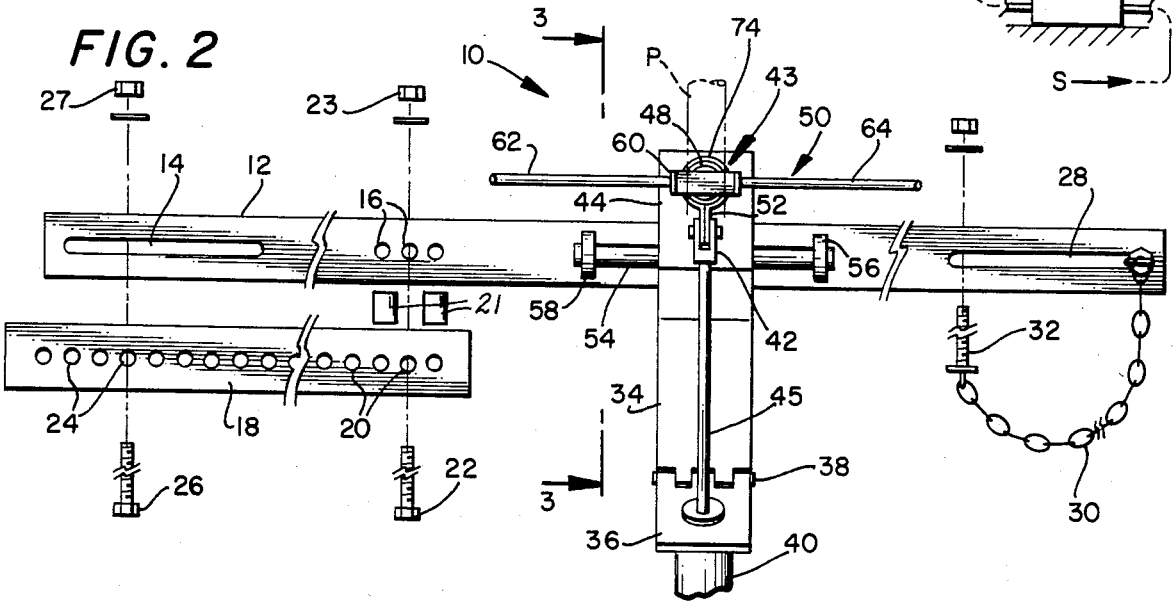

GUIDE MEANS FOR STABILIZING PIPE STRINGS

BACKGROUND OF THE INVENTION

There are numerous prior art devices for receiving and centering a vertical section of pipe as the pipe is removed from and added to a pipe string associated with a borehole. The added or removed sections of pipe are held in suspended relationship respective to the borehole and to the suspended string of pipe remaining in the borehole so as to enable the confronting pipe ends to be properly mated. The following U.S. Pat. Nos. illustrate that part of the prior art considered most pertinent to the present disclosure:

2,692,059; 3,533,516; 4,172,684; 4,432,691;
2,828,024; 4,111,388; 4,274,777; 4,440,536.

Reference is made to the above prior art as well as to the references cited therein and the entire field of search suggested by such prior art. In the prior art apparatus known at this time, the various different devices for positioning pipe respective to a drilling derrick or workover rig are complex and usually semi-permanently attached to the rig.

There are geographical areas where the winds reach a very high velocity, and it is often necessary for a workover rig, for example, to continue working in such adverse weather conditions. This is because the workover rig and crew are expensive and it is not always feasible or economically expedient to suspend a workover operation merely because of adverse weather conditions. High winds tend to oscilate or laterally move a pipe string in unexpected directions, and therefore constitute a danger to the workmen and the equipment associated with such a borehole operation.

Accordingly, it is desirable to have made available a device for stabilizing a suspended section of the pipe string respective to the derrick in a safe, fast, and economical manner. It is furthermore desirable that such a device be removably affixed to the derrick so that the apparatus is easily attached to and thereafter removed from the derrick so that the apparatus is available for use in conjunction with each of the workover operations. An apparatus which achieves these desirable goals is the subject of the present invention.

SUMMARY OF THE INVENTION

The present invention discloses an apparatus for positioning and stabilizing a section of pipe string respective to a derrick. The derrick usually is part of a workover rig, and the pipe string usually is production tubing. The apparatus of this invention includes a main frame which is removably affixed to the derrick structure at a location that aligns a yoke of a novel stabilizer assembly in a position to capture a medial portion of the pipe section or pipe string therewithin.

The stabilizer assembly is pivotally mounted respective to the derrick main frame and is actuated by a power cylinder. The power cylinder moves the stabilizer assembly from a retracted, substantially vertical position into an extended, substantially horizontal position.

The yoke of the stabilizer assembly is attached to a jack assembly which enables adjustably positioning the yoke apex respective to the axial centerline of the wellbore. The jack assembly has a base which is hingedly affixed to the main frame and thereby provides the pivoting movement of the stabilizer assembly. The jack assembly has a barrel attached to the base, and further includes an extension member which is telescopingly received in attached relationship within the barrel. Means are provided by which the extension member can be telescoped into and out of the barrel.

The yoke includes an apex end which is attached to the free end of the extension member. The yoke also includes opposed, outwardly extending arms which diverge from one another in an outward direction. The apex of the yoke is of a size to receive and capture a pipe string therewithin. The main frame of the yoke includes fastener means by which the apparatus can be affixed to the structure of any workover or drilling rig.

Accordingly, a primary object of the present invention is the provision of apparatus associated with a workover rig for stabilizing a section of a pipe string as the pipe section is being made up prior to being lowered into the borehole.

A further object of the invention is the provision of a stabilizer apparatus which can be removably affixed to a derrick, wherein the derrick moves tubular goods into and out of a borehole, and wherein the apparatus can be retracted out of the path of the pipe string or extended into a position to capture a section of a pipe string and thereby stabilize the pipe section respective to the pipe string while a connection is being made.

Another object of the present invention is the provision of apparatus for guiding and stabilizing one or more pipe joints while a connection with a pipe string is being made so that the string thereafter can be lowered into a borehole by a traveling block associated with an oilfield derrick; and wherein the apparatus includes a yoke for capturing a medial length of the vertically suspended pipe joint therewithin in a manner to stabilize the pipe and facilitate making up the pipe into the pipe string.

A still further object of the present invention is the provision of apparatus for positioning and stabilizing a pipe joint to facilitate making a connection respective to a pipe string; comprising, a yoke apparatus which can be retracted into a position removed from the pipe string and extended into a substantially horizontal position for capturing the upper marginal end of the pipe string, with there being means for adjusting the yoke position in order to align the yoke with the axial centerline of the pipe string, and wherein the apparatus is removably affixed to the derrick of a pulling unit or the like.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

BRIEF DESCRIPTION OF THE DRAWINGS

FIG. 1 is a fragmentary, side elevational view of a derrick having apparatus made in accordance with the present invention associated therewith;

FIG. 2 is a partially disassembled, front elevational view of the apparatus disclosed in FIG. 1;

FIG. 3 is an enlarged, fragmentary, detailed view of part of the apparatus disclosed in the foregoing figures;

DETAILED DESCRIPTION OF THE PREFERRED EMBODIMENT

Figure 4:
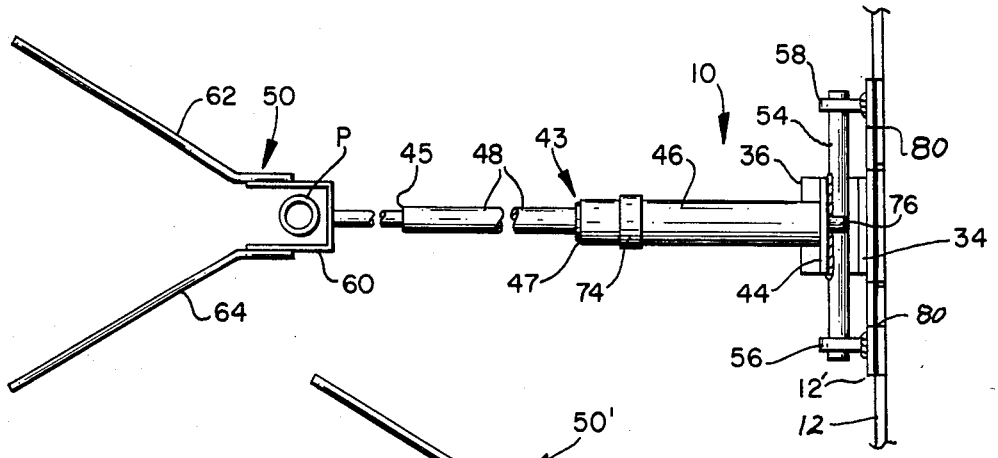
FIG. 4 is a top plan view of the apparatus disclosed in FIG. 1.

FIG. 1 is a fragmentary, side elevational view of a derrick D, such as associated with a pulling unit or a drilling rig, when the derrick D manipulates a string of pipe P as the string is made up or broken down into joints or stands of pipe. Apparatus 10, made in accordance with the present invention, guides and stabilizes the pipe joint or pipe section while a connection is being made, and thereafter the pipe string is lowered into the borehole.

As seen in various figures of the drawings, the apparatus 10 includes a main frame 12 having an elongated, longitudinally extending slot 14 at one marginal end thereof. A plurality of apertures 16 form bolt holes which facilitate the accommodation of an overlapping plate member 18. The overlapping plate member 18 is provided with a plurality of apertures 20 for receiving bolts 22 therethrough. The other marginal end of the plate member 18 is provided with apertures 24 which likewise form bolt holes for receiving bolts 26 therethrough. Annular spacer 21 separates members 12 and 18 and receives bolts 22 therethrough. Bolt 22 therefore, is received through the spacer 21 and through the bolt holes 20 and 16, nut 23 is made up, thereby attaching plate members 12 and 18 together in spaced relationship. Bolt 26 is similarly received through holes 24 and elongated slot 14, and nut 27 is made up respective to the bolt for securing the other marginal end of plate 18 to the marginal end of main frame member 12 if desired.

An elongated longitudinally extending slot 28 is formed within the other marginal end of the main frame 12. Chain 30 has one end attached for movement along slot 28 while the other end is provided with a bolt 32 which likewise is received in slidable captured relationship respective to slot 28.

A downwardly depending, vertically arranged, plate 34 is welded or otherwise affixed to a lower edge of the main frame 12. The plate 34 lies parallel respective to the main frame 12. A cylinder mounting plate 36 has one end thereof pivotally mounted to the free end of the plate 34 by means of hinge 38. The hinge 38 can take on several different forms so long as the hinge has ample structure integrity for the service set forth herein.

Power cylinder 40 is affixed to and supported by the hinge plate 36. The power cylinder includes a piston 45 reciprocatingly received therewithin, with the free end of the piston being provided with an attachment lug 42.

A jack assembly 43 is affixed to and supported by a plate 44. The jack assembly 43 includes a barrel 46 attached to the plate 44. The jack includes a mandrel or internal member 48 reciprocatingly received within the barrel 46, with a free end of the member 48 extending from the barrel 46. A yoke assembly 50 is attached to the distal end of the jack mandrel.

As best seen in FIG. 1, together with other figures of the drawings, the jack assembly is provided with an attachment lug 52 which is pivotally secured to lug 42 of the piston 45 of power cylinder 40.

Looking again now to FIGS. 1 and 2, together with other figures of the drawings, the plate 44 preferably is welded or otherwise affixed to an elongated journaled member 54. The journaled member 54 is received within bearings 56, 58, with the bearings being supported in attached relationship respective to the main frame 12. Accordingly, plate member 44 can be pivotally moved in a vertically disposed plane, thereby moving the yoke 50 of the stabilizer from the retracted position 50' into the extended position 50 indicated in FIG. 1.

In FIG. 4, the yoke 50 is operatively positioned respective to a pipe joint, pipe section, or pipe string P. The yoke apex 60 is of a boxed configuration, opened at one side, with there being opposed arms 62, 64 depending from the apex and diverging from one another to thereby enable a pipe P to be easily gathered into the apex 60.

Figure 7:
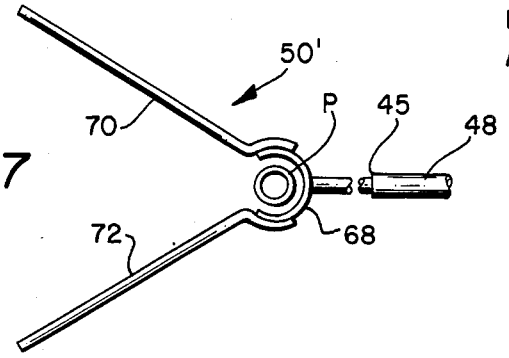

In FIG. 7, the yoke assembly 50' comprises a discontinuous cylinder 68 having an opening through the sidewall thereof of a sufficient width to gather pipe P into the apex thereof. The sidewalls of the apex diverge from one another and are outwardly extended in the form of diverging gathering arms 70, 72.

Numeral 74 of FIG. 4 indicates a circular band which encompasses the jack housing 46 and terminates in the form of the before mentioned lug 52, wherein the lug 52 receives the coacting lug 42 which is attached to the free end of piston 43 of power cylinder 40 as seen in FIG. 1, for example. Numeral 76 of FIG. 4 indicates an attachment engageable by a crank for rotating the threaded mandrel 48 and thereby extending the inner mandrel 48 from the outer barrel 46 of the jack 43.

Figure 5:
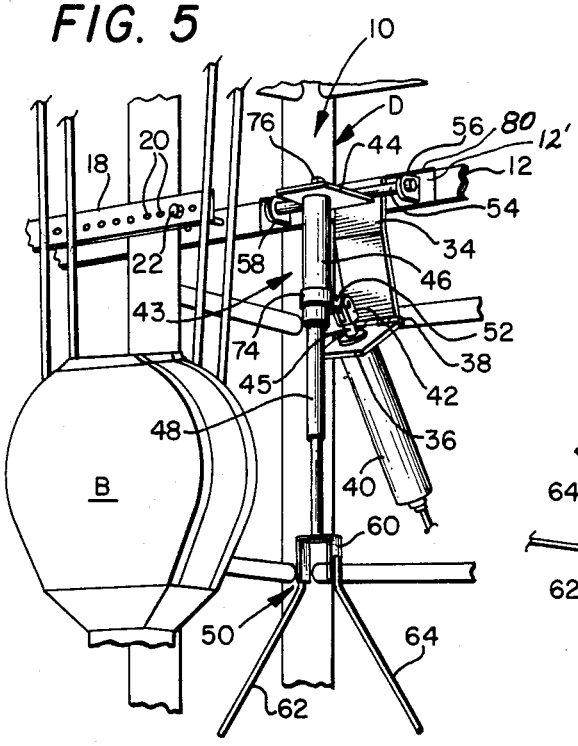
FIG. 5 is a perspective view of the apparatus disclosed in FIG. 1, shown in an alternate operative configuration, and in conjunction with part of a derrick.
Figure 6:
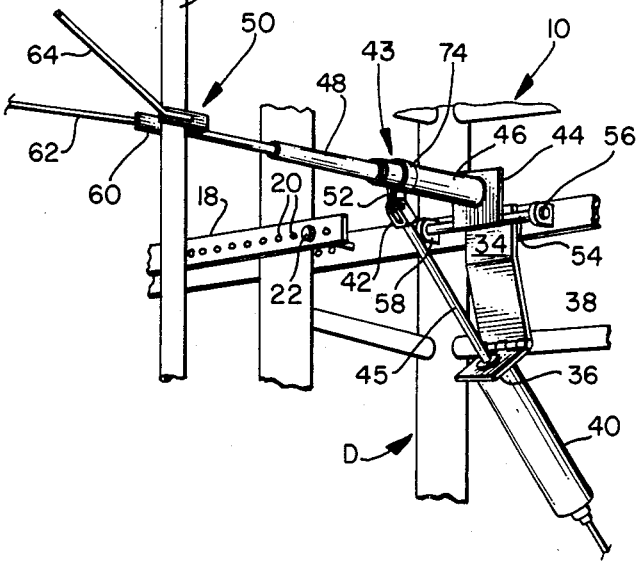
FIG. 6 is a perspective view of the apparatus of the present invention, showing the apparatus in the extended configuration; and, FIG. 7 is a broken, top plan view which sets forth an alternate embodiment of part of the apparatus of this invention.

In FIGS. 4 and 5, the main frame 12 includes a hinged superimposed member 12' joined together along the upper edges thereof by a hinge means 80, thereby enabling the yoke, jack, and power cylinder to be pivoted in an upward direction, should the yoke be contacted by the traveling block B while in the extended position.

In operation, the pipe guiding and stabilizing apparatus 10 is hoisted up into the derrick D by utilizing any suitable line associated with the drilling rig or workover unit. The apparatus 10 is positioned to receive the upper third of a pipe section P within the apex 60 or 68 of the extended yoke 50 or 50'. The main frame 12 is removably attached to one of the main structural members of the derrick D by first moving the spaced members 12, 18 towards a derrick leg so that the leg is received therebetween. Next, the apparatus is lowered until the members 12, 18 sit down on a derrick cross-member. The entire apparatus 10 can now easily be pivoted into engagement with an adjacent derrick leg, and thereafter secured thereto by looping the chain 30 about the derrick member, and securing the distal end of the chain by utilizing slot 28 and bolt 32. The other end of the main frame can then be further secured to the derrick, if desired, by securing the ends of the overlapping plate 18 to the main frame 12 by means of bolt 26 in the illustrated manner of FIGS. 1, 2, 5, and 6, so that the structural member of the derrick D is clamped between bolts 22, 26, and members 12, 18.

Next, a suitable source of air is provided for foot control 78, which preferably is supported on the derrick floor. When the foot control 78 is actuated, power fluid from source S flows to the power cylinder 40, thereby extending piston 45 therefrom, and forcing the stabilizer assembly to move from position 50' into position 50 of FIG. 1. When the foot control 78 is released, the stabilizer assembly 50 is retracted into the illustrated position 50' and is disengaged from the pipe joint P.

An important aspect of the present invention is the arrangement of plates 34, 44 which extend in opposition to one another when the yoke is in the extended configuration, and thereby provide improved geometry for the resultant force vectors associated with pivot points 38, 42, 56, which must be varied in the indicated manner of FIG. 1 in order to move the stabilizer assembly in the above described manner. Another important aspect of this invention is the spaced apart relationship of the journals 56, 58 of FIG. 2 which impart lateral stability into the plate member 44 and thereby prevent undue lateral motion of the yoke 50 as the yoke 50 receives the pipe P within apex 60 thereof and loosely captures the pipe therewithin while the pipe is being manipulated.

Another important feature of the present invention is the provision of the jack apparatus 43 by which the yoke 50 can be extended toward and away from the longitudinal axial centerline of the pipe P.

Furthermore, it is believed novel to be able to attach the main frame 12, 12' within the derrick D in the above described manner, which can be accomplished by one workman in a safe and expedient manner.

Still another important feature of this invention is the provision of the hinged main frame member, which allows the member 12' to pivot respective to the member 12, so that should the driller neglect to retract the yoke 50 prior to elevating the traveling block B, the entire assembly 12', 44, 34, 50, 43, 46, and 40 will rotate about hinge means 80 and avoid serious damage to the derrick and to the apparatus.

I claim:

1. Apparatus for positioning and stabilizing a section of pipe respective to a derrick comprising:

a main frame, a stabilizer assembly pivotally mounted respective to said main frame, power cylinder means attached between said main frame and said stabilizer assembly for pivotally moving said stabilizer assembly from a retracted substantially vertical position into an operative horizontal position;

said stabilizer assembly includes a yoke attached to a jack;

said jack includes a base hingedly affixed to said main frame to provide for the aforesaid pivotally mounted arrangement; said jack comprises a barrel attached to said base, an extension member telescopingly received in attached relationship within said barrel, means for extending said extension member respective to said barrel;

said main frame includes an elongated slot at opposed marginal ends thereof, a chain attached to the main frame in close proximity to one said slot, a fastener member at the free end of the chain, so that said chain can be wrapped about a structural member of a derrick and fastened back to the slot;

a plurality of apertures spaced from and adjacent to the other opposed slot, an overlapping plate member having apertures formed therein which may be concurrently brought into alignment with the apertures and slot; and, fastener means received through the main frame and the overlapping plate;

said yoke having an apex end attached to a free end of the extension member, and opposed outwardly extending arms which diverge from one another in an outward direction, said apex being of a size to receive and capture a section of pipe therewithin.

2. The apparatus of claim 1 wherein said jack is attached to a pad, means pivotally attaching the pad to said main frame; the pivoted pad having opposed ends which extend outwardly thereof, journal means by which the opposed ends are mounted to said main frame.

3. The apparatus of claim 2 wherein a plate member is attached to said main frame and extends in opposition to said pad; said plate member hingedly receives the base of the power cylinder, thereby separating the base of the power cylinder from the base of the jack and at the same time providing pivotal motion in a vertical plane for the jack and the power cylinder.

4. The apparatus of claim 1 wherein said jack is attached to a pad, and the pad is attached to a pivoted member, with the pivoted member having opposed ends which extend outwardly of the pad, journal means by which the opposed ends are mounted to the main frame;

said power cylinder is attached to a plate member which extends in opposition to the pad, said plate member is hingedly received on the main frame, thereby separating the base of the power cylinder from the base of the stabilizer member and at the same time providing pivotal motion in a vertical plane for the stabilizer member and the power cylinder.

5. Apparatus for positioning and stabilizing a section of pipe respective to a derrick, comprising:

a main frame, a stabilizer assembly pivotally mounted respective to said main frame, power cylinder means attached between said main frame and said stabilizer assembly for pivotally moving said stabilizer assembly from a retracted position into an operative, substantially horizontal position;

said stabilizer assembly includes a yoke attached to a jack means; said jack means has a base and a barrel attached to said base, an extension member telescopingly received in attached relationship within said barrel, means for extending said extension member respective to said barrel; said base of said jack means is a pad, means pivotally attaching the pad to said main frame; the pivoted pad having opposed ends which extend outwardly thereof, journal means by which the opposed ends are mounted to said main frame to provide for the aforesaid pivotally mounted arrangement;

said yoke having an apex end attached to a free end of the extension member, and opposed outwardly extending arms which diverge from one another in an outward direction, said apex being of a size to receive and capture a section of pipe therewithin;

a plate member is attached to said main frame and extends in opposition to said pad; said plate member hingedly receives the base of the power cylinder, thereby separating the base of the power cylinder from the base of the jack and at the same time providing motion in a vertical plane for the jack and the power cylinder;

and means by which said main frame is removably mounted within a derrick in aligned relationship with the borehole to thereby enable the yoke apex to receive a marginal length of a pipe section therewithin, so that a pipe section is axially aligned with a pipe string and thereby facilitates making a connection.

6. The apparatus of claim 5 wherein said main frame includes a first and second superimposed members attached in spaced relationship to one another and arranged to receive a derrick leg therebetween, a chain attached to the first member of the main frame in close proximity to one end thereof; a fastener member at the free end of the chain, so that said chain can be wrapped about one structural member of a derrick and fastened back to a slot.

7. The apparatus of claim 6 wherein the main frame includes a first and second member superimposed on one another, hinge means connecting the upper edge of said first and second member together, the first member of the main frame being attached to the derrick, the jack means and power cylinder being attached to the second member; so that the yoke and jack can be pivoted in an upward direction upon being inadvertently contacted by a traveling block of a pulling unit.

8. Apparatus for positioning and stabilizing a section of pipe respective to a derrick comprising:

a main frame, a stabilizer assembly, means pivotally mounting said stabilizer assembly respective to said main frame, power cylinder means attached between said main frame and said stabilizer assembly for pivotally moving said stabilizer assembly from a retracted substantially vertical position into an operative horizontal position; said stabilizer assembly includes a yoke attached to a jack;

said jack comprises a barrel, a base, one end of said barrel being attached to said base, an extension member telescopingly received in attached relationship within said barrel, means for extending said extension member respective to said barrel;

said yoke having an apex end attached to a free end of the extension member, and opposed outwardly extending arms which diverge from one another in an outward direction, said apex being of a size to receive and capture a section of pipe therewithin;

said power cylinder means includes a base; a plate member has a near end attached to said main frame and extends in opposition to the base of the jack, said plate member has a far end which hingedly receives the base of the power cylinder, thereby separating the base of the power cylinder from the base of the jack and at the same time providing pivotal motion in a vertical plane for the jack and the power cylinder; said power cylinder having a piston reciprocatingly received therewithin which extends into attached relationship to the jack barrel;

said base having opposed ends which extend outwardly away from said barrel, journal means by which the opposed ends of said base are mounted to said main frame to provide for the aforesaid pivotally mounting of the stabilizer assembly;

and means by which said main frame can be removably mounted respective to a derrick at a location which enables the yoke apex to receive a marginal length of a pipe section therewithin.

9. The apparatus of claim 8, wherein said main frame includes an elongated slot at opposed marginal ends thereof, means, including a chain, attached to the main frame in close proximity to one said slot, a fastener member at the free end of the chain, so that said chain can be wrapped about a structural member of a derrick and fastened back to the slot; and thereby provide the means by which the main frame is removably mounted respective to a derrick.

* * * * *